US010046205B1

(12) United States Patent
Hogge et al.

(10) Patent No.: US 10,046,205 B1
(45) Date of Patent: Aug. 14, 2018

(54) GOLF BALL INCORPORATING THIN THERMOFORMED PRE-FORM(S) HAVING LOW NORMALIZED MOISTURE VAPOR TRANSMISSION RATE

(71) Applicant: Acushnet Company, Fairhaven, MA (US)

(72) Inventors: Matthew F. Hogge, Plymouth, MA (US); Peter L. Serdahl, New Bedford, MA (US); Bruce Tavares, New Bedford, MA (US); Derek A. Ladd, Acushnet, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 15/466,916

(22) Filed: Mar. 23, 2017

(51) Int. Cl.
*A63B 37/00* (2006.01)

(52) U.S. Cl.
CPC ..... *A63B 37/004* (2013.01); *A63B 37/0045* (2013.01); *A63B 37/0075* (2013.01); *A63B 37/0076* (2013.01); *A63B 37/0078* (2013.01); *A63B 37/0038* (2013.01); *A63B 37/0039* (2013.01)

(58) Field of Classification Search
CPC ..... A63B 37/004; A63B 37/0045; A63B 37/0003; A63B 37/0029; A63B 37/0033; A63B 27/0039; A63B 27/0038
See application file for complete search history.

(56) References Cited

U.S. PATENT DOCUMENTS 5,820,488 A 10/1998 Sullivan et al.
5,875,891 A 3/1999 Snell
5,885,172 A 3/1999 Hebert et al.
6,132,324 A 10/2000 Hebert et al.
6,132,544 A 10/2000 Ihara
6,232,389 B1 5/2001 Feeney et al.
6,267,693 B1 7/2001 Sullivan
6,287,216 B1 9/2001 Boehm
6,336,871 B1 * 1/2002 Ihara ..... A63B 37/0003 473/367
6,398,668 B1 * 6/2002 Wai ..... A63B 37/0003 473/374
6,494,792 B2 12/2002 Sullivan
6,632,147 B2 10/2003 Cavallaro et al.
6,806,347 B2 10/2004 Hogge et al.
6,838,028 B2 1/2005 Hogge et al.
6,932,720 B2 8/2005 Hogge et al.
7,004,854 B2 2/2006 Hogge et al.
7,004,855 B2 2/2006 Jordan
7,182,702 B2 2/2007 Hogge et al.
7,306,528 B2 12/2007 Jordan
7,357,733 B2 4/2008 Hogge et al.
8,303,436 B2 11/2012 Sullivan et al.
8,454,455 B2 6/2013 Cavallaro
8,907,022 B2 12/2014 Hayes et al.
9,393,462 B2 7/2016 Farrell
9,427,629 B1 8/2016 Binette et al.
9,433,826 B1 9/2016 Comeau et al.
2003/0069082 A1 * 4/2003 Sullivan ..... A63B 37/0003 473/357
2003/0069085 A1 * 4/2003 Hogge ..... A63B 37/0003 473/371
2003/0114247 A1 * 6/2003 Cavallaro ..... A63B 37/0003 473/357
2003/0130062 A1 7/2003 Morgan et al.
2004/0147344 A1 7/2004 Sullivan et al.
2004/0185963 A1 9/2004 Hogge et al.
2006/0068938 A1 3/2006 Sullivan
2006/0128505 A1 6/2006 Sullivan et al.
2007/0015879 A1 * 1/2007 Sullivan ..... A63B 37/0003 525/386
2007/0129172 A1 6/2007 Cavallaro
2008/0064528 A1 3/2008 Jordan
2008/0261721 A1 10/2008 Hogge et al.
2009/0169741 A1 * 7/2009 Hogge ..... A63B 37/005 427/241
2010/0248862 A1 * 9/2010 Sullivan ..... A63B 37/0039 473/373

* cited by examiner

*Primary Examiner* — John E Simms, Jr.
(74) *Attorney, Agent, or Firm* — Margaret C. Barker

(57) ABSTRACT

Golf ball comprising: a subassembly; a moisture barrier film layer having a continuous and substantially uniform thermoformed thickness of less than 0.020 inches and consisting of first and second heat-induced pre-form film half shells having first and second inner surfaces that are sized, shaped and contoured to receive and conformally and adhesively mate onto and about the subassembly such that the moisture barrier film layer has a normalized Moisture Vapor Transmission Rate ("'nMVTR") of less than 4.0 g/(m2·day); and at least one outer layer disposed about an outer surface of the moisture barrier film layer that has an nMVTR greater than the nMVTR of the moisture barrier film layer. Alternatively, the thermoformed thickness is from about 0.003 inches to less than 0.020 inches; or 0.0035 inches to 0.010 inches; or from about 0.01 inches to less than 0.020 inches; or from greater than about 0.0035 inches to 0.005 inches.

9 Claims, No Drawings

GOLF BALL INCORPORATING THIN THERMOFORMED PRE-FORM(S) HAVING LOW NORMALIZED MOISTURE VAPOR TRANSMISSION RATE

FIELD OF THE INVENTION

Durable golf balls incorporating thin moisture barrier film layers.

BACKGROUND OF THE INVENTION

Conventional golf balls can be divided into two general classes: solid and wound. Solid golf balls include one-piece, two-piece (i.e., single layer core and single layer cover), and multi-layer (i.e., solid core of one or more layers and/or a cover of one or more layers) golf balls. Wound golf balls typically include a solid, hollow, or fluid-filled center, surrounded by a tensioned elastomeric material, and a cover.

Examples of golf ball materials range from rubber materials, such as balata, styrene butadiene, polybutadiene, or polyisoprene, to thermoplastic or thermoset resins such as ionomers, polyolefins, polyamides, polyesters, polyurethanes, polyureas and/or polyurethane/polyurea hybrids, and blends thereof. Typically, outer layers are formed about the spherical outer surface of an innermost golf ball layer via compression molding, casting, or injection molding.

From the perspective of a golf ball manufacturer, it is desirable to have materials exhibiting a wide range of properties, such as resilience, durability, spin, and "feel," because this enables the manufacturer to make and sell golf balls suited to differing levels of ability and/or preferences. In this regard, playing characteristics of golf balls, such as spin, feel, CoR and compression can be tailored by varying the properties of the golf ball materials and/or adding additional golf ball layers such as at least one intermediate layer disposed between the cover and the core. Intermediate layers can be of solid construction, and have also been formed of a tensioned elastomeric winding. The difference in play characteristics resulting from these different types of constructions can be quite significant.

A known problem with golf balls is that water vapor sometimes penetrates into golf ball materials, which can harmfully affect golf ball properties. For example, when a polybutadiene core cross-linked with peroxide and/or zinc diacrylate absorbs water, the core tends to lose resiliency, and the compression and coefficient of restitution (CoR) of the ball may change.

Typically, at 38° C. and 90% humidity over a sixty day period, significant amounts of moisture can enter the cores and reduce the initial velocity of the balls by 1.8 ft/s to 4.0 ft/s or greater. The change in compression may vary from about 5 PGA to about 10 PGA or greater. The absorbed water vapor also reduces the golf ball CoR. When a golf ball is subjected to prolonged storage and/or use under ambient conditions such as 25-35% RH, as well as conditions of high temperature and high humidity, the CoR of the golf ball tends to decrease over time due to water vapor absorption. Unfortunately, at least some widely used polyurethane cover materials also tend to be vulnerable to moisture penetration, and therefore can't adequately protect the core.

The industry has addressed such problems by applying a moisture barrier layer over a golf ball material that would otherwise be vulnerable to water penetration. In this regard, an effective moisture barrier layer has a moisture vapor transmission rate (MVTR) that is low enough to create a barrier against moisture penetration into the enveloped material and thereby protect the material against the negative effects of water.

It has been determined that in many golf balls, the moisture barrier layer should be as thin as is possible in order to avoid compromising other important golf ball properties such as CoR, durability, and compression or unnecessarily increasing manufacturing costs. Initially, golf ball manufacturers tried using very thin layers of injection molded moisture barrier material, which undesirably tended to create non-concentric, non-conformal layers containing pin holes and having non-uniform thicknesses, each which can produce undesirable performance characteristics and/or present durability issues.

Accordingly, coating layers of moisture barrier material have also been explored, but can present layer thickness uniformity issues, as well as adhesion and durability problems when air pockets formed at an interface between the coating material and adjacent inner layer. In this regard, prior thin moisture barrier coating layers of nano-composite filled elastomeric coatings containing exfoliated platelet particles or a specialized low transmission polymer such as polyvinylidene chloride ("PVDC") have displayed interlayer adhesion problems, durability issues, resilience deficiency, and loss of barrier effectiveness when the moisture barrier coating layer cracks due to impact by a golf club. The barrier properties of PVDC coatings are typically best at or below ambient (room) temperature (~68-77° F.), but degrade rapidly at elevated temperatures.

Thus, golf ball manufacturers have instead tried thin film layers of moisture barrier material. For example, very thin metallic film layers have been incorporated for this purpose. See, e.g., U.S. Pat. No. 9,433,826 of Comeau et al. However, a catalytic coating pre-treatment is generally needed in connection with such films, which can complicate as well as add to the cost of golf ball manufacture. In a different approach, flat ionomer resin film sheets having a thicknesses of from 10 microns (um) to less than 300 um were compression molded about a ball body while dimples were also being formed in the resin. However, there was no way to prevent the resin sheets of moisture barrier material from overlapping in some areas on the ball body surface during the heat compression molding process, which tended therefore to produce non-uniformity in the resulting film layer and adhesion issues between the film and encased ball body at an interface there between.

In an alternative approach, very thin ionomer sheet blanks were vaccuum-suctioned into and within inner faces of concave hemispherical cup-shaped half-shell molds. Preformed half shells of thin moisture barrier film were thereby produced having a thickness of no greater than 1.5 mm, but durability issues could arise because this method permitted the outer diameter and shape of the resulting pre-formed cup-shaped half-shell films to differ from the diameter and shape of the inner face of the mold which could result in gaps between the cup-shaped films and an encased core/subassembly since the contour of the film pre-form did not always match the contour of the encased core/subassembly.

Meanwhile, a major challenge encountered with incorporating thin film moisture barrier layers in golf ball constructions is achieving excellent normalized MVTR (nMVTR) criteria while still producing a material able to withstand the degree of elongation sufficient for sustaining the tremendous force of a golf club face striking the golf ball. Normalized MVTRs compare the ability of materials to resist moisture penetration irrespective of the thickness of the material and can be determined by the equation VTR $(g \cdot mm/m^2 \cdot day) \cdot (1/$ thickness (mm)) or g/(m$^2$·day). For example, ionomers typically have an nMVTR of from 9 to 12, which is not ideal. And while polyvinylidene chloride coatings can demonstrate nMVTRs in the range of 3.9 to 6.3, such coatings generally have the limitations of coatings discussed above.

Accordingly, there is a need for golf ball constructions that can incorporate very thin film components of moisture barrier material that have excellent nMVTRs, yet: 1) are shaped and sized so as match/follow the shape and contour of an encased core/subassembly so as to avoid gaps between layers; 2) have a uniform thickness; 3) have sufficient elongation properties to withstand a club strike; and 4) do not negatively impact or alter the desired playing characteristics of the golf ball. Such golf balls and methods of making the golf balls would be useful and desirably cost effective. Golf balls of the invention and methods of making golf balls of the invention address and solve these needs.

SUMMARY OF THE INVENTION

Therefore, golf balls of the invention incorporate at least one very thin moisture barrier film layer having a normalized Moisture Vapor Transmission Rate ("'nMVTR") of less than 4.0 and having a contour which matches/follows the shape and contour of a core/subassembly when formed about the subassembly it encases and having a pre-formed construction that provides a uniform thickness and eliminates the aforementioned durability issues of prior very thin moisture barrier layer constructions. In one embodiment, a golf ball of the invention comprises: a subassembly; a moisture barrier film layer having a continuous and substantially uniform thermoformed thickness of less than 0.020 inches and consisting of first and second heat-induced pre-form film half shells having first and second inner surfaces that are sized, shaped and contoured to receive and conformally and adhesively mate onto and about the subassembly such that the moisture barrier film layer has an nMVTR of less than 4.0 g/(m2·day); and at least one outer layer disposed about an outer surface of the moisture barrier film layer that has an nMVTR greater than the nMVTR of the moisture barrier film layer.

In a particular embodiment, the moisture barrier film layer has a thermoformed thickness of from about 0.003 inches to less than 0.020 inches. The moisture barrier film layer may have an nMVTR of about 0.5 g/(m$^2$·day). In a specific such embodiment, the moisture barrier film layer may have a thermoformed thickness of from greater than about 0.0035 inches to 0.010 inches. The moisture barrier film layer may be five-ply—that is, consist of five film layers, wherein a second film layer and a fourth film layer are tie layers, and a third film layer is disposed between the second film layer and fourth film layer and consists of a moisture barrier composition. A first film layer of the five film layers may consist of a low density polyethylene composition, the second film layer may consist of an ethylene vinyl acetate composition, the third film layer may consist of a polyvinylidene chloride composition, the fourth film layer may consist of an ethylene vinyl acetate composition, and a fifth film layer may consist of a low density polyethylene composition.

In one such embodiment, the five film layers may have substantially similar thicknesses. In another embodiment, the second film layer may have a thickness that is substantially similar to a thickness of the fourth film layer, and each of the first film layer, third film layer, and fifth film layer may meanwhile have a thickness that is greater than the thickness of the second film layer and fourth film layer.

In an alternative such embodiment, the moisture barrier film layer may have a thermoformed thickness of from about 0.01 inches to less than 0.020 inches. Each of the first and second heat-induced pre-form film half shells may consist of a polyolefin-based vulcanized thermoplastic elastomer composition.

In a different embodiment, the moisture barrier film layer may have a normalized MVTR of about 0.8 g/(m2·day). The moisture barrier film layer may have a thermoformed thickness of from greater than about 0.0035 inches to 0.010 inches. Each of the first and second heat-induced pre-form film half shells of the moisture barrier film layer may consist of a polyethylene ionomer copolymer composition.

In one embodiment of a golf ball of the invention, the subassembly of the inventive golf ball may consist of a single layer solid rubber-based core having a spherical outer surface, and the outer layer may be a cover comprised of a thermoset or thermoplastic polyurethane composition, wherein the golf ball has a CoR of at least about 0.800.

In another embodiment of a golf ball of the invention, the subassembly of the inventive golf ball may consist of a core having a spherical solid rubber-based inner core layer, surrounded by at least one outer core layer; wherein the outer layer is a cover comprised of a thermoset or thermoplastic polyurethane composition, wherein the golf ball has a CoR of at least 0.800.

In one embodiment, the subassembly of the inventive golf ball may have an outermost layer comprising a highly neutralized polymer composition, about which the moisture barrier film layer is disposed. In such an embodiment, the outermost layer should have an nMVTR that is greater than the nMVTR of the moisture barrier film layer.

In one embodiment, an adhesive strength between the film layer and an adjacent inner layer is at least about 1.1 lb$_f$/in. In another embodiment, an adhesive strength between the film layer and an adjacent outer layer is at least about 15 lb$_f$/in.

The present invention also relates to a method of making a golf ball comprising: providing a subassembly; providing first and second film sheets having identical thicknesses of 0.020 inches or less, and heating the first and second film sheets sufficient to soften and drape each film sheet onto and about first and second molds that have the same size, shape and outer surface contour as an outer surface of the subassembly, wherein the first and second molds are comprised of material that will not adhere to the first and second film sheets during draping; cooling each film sheet on the first and second molds and forming first and second heat-induced pre-form film half shells having first and second inner surfaces that are sized, shaped and contoured to receive and conformally and adhesively mate with an outer surface of the subassembly; removing the first and second heat-induced film pre-form half shells from the first and second molds; thermoforming the first and second heat-induced film pre-form half shells onto and about the outer surface of the subassembly and forming a moisture barrier film layer about the outer surface, wherein the moisture barrier film layer has a continuous and substantially uniform thickness of less than 0.020, and is conformally and adhesively mated with the outer surface such that the moisture barrier film layer has an nMVTR of less than 4.0 g/(m2·day); and forming at least one outer layer about the moisture barrier film layer that is comprised of a polymeric material having an MVTR that is greater than the nMVTR of the moisture barrier film layer. In a particular embodiment, a vacuum may be applied or otherwise created during the step of heating the first and second film sheets sufficient to soften and drape each film sheet onto and about the first and second molds.

DETAILED DESCRIPTION OF THE INVENTION

A durable golf ball of the invention displays excellent adhesion between a very thin moisture barrier film layer and adjacent inner and outer conventional golf ball layers, without meanwhile negatively impacting or altering desirable playing characteristics. The moisture barrier film layer has an nMVTR (as defined in the Background of the Invention), of less than 4.0 g/(m2·day), has a continuous and substantially uniform thermoformed thickness of less than 0.020 inches, and consists of first and second heat-induced pre-form film half shells having first and second inner surfaces that are sized, shaped and contoured to receive and conformally and adhesively mate onto and about a subassembly. At least one outer layer having an nMVTR greater than the nMVTR of the moisture barrier film layer may be disposed about an outer surface of the moisture barrier film layer.

As used herein, the phrase "first and second heat-induced pre-form film half shells" refers very thin half shell-shaped films having the specified thickness and are produced by exposing very thin first and second sheets of film material to heat sufficient to soften and drape same about a mold outer surface having the same size and shape as an outer surface of the subassembly. The mold consists of a composition that will not adhere to the first and second sheets of film material during softening and draping. Using heat-induced vacuum molding permits the sheets of film to drape onto and about the mold and produce first and second heat-induced pre-form film half shells having inner surfaces that are sized and shaped to be conformal with the outer surface of the subassembly and continuously adhesively mate therewith. Interactions between the first and second inner surfaces and the outer surface of the subassembly at an interface there between produces strong adhesion and first and second heat-induced pre-form film half shells provide uniform and continuous protection to the subassembly against moisture penetration. In a specific embodiment, a vacuum may be applied during softening and draping of the first and second film sheets onto and about first and second molds in order to produce the inner surfaces of the film sheets having the same size, shape and outer surface contour as the outer surface of the subassembly.

As used herein, the term "thermoformed thickness" therefore refers to the thickness of the moisture barrier film layer resulting from such heat effectuated vacuum molding of film sheets, followed by heat-induced compression molding of the first and second heat-induced pre-form film half shells about the outer surface of the subassembly. Advantageously, in a finished golf ball of the invention, the resulting moisture barrier film layer can be at least 50% thinner than the thickness of the film sheets being provided and softened and draped onto and about the mold. This desirably creates a resulting very thin moisture barrier film layer which protects the inner layers from moisture penetration without meanwhile changing performance characteristics and/or presenting durability issues. This is due at least in part to the continuous and uniform thickness of the very thin moisture barrier film layer that is conformal about the adjacent inner layer and free from the pin holes found in prior moisture barrier layers.

Accordingly, each draped film sheet, once cooled on its mold, may then be removed therefrom as first and second heat-induced pre-form film half shells and heat-induced compression molded onto and about the outer surface of the subassembly as a moisture barrier film layer having a continuous and substantially uniform thickness of less than 0.020, and being conformally and adhesively mated onto and about the outer surface. At least one outer layer, having an nMVTR that is greater than the nMVTR of the moisture barrier film layer, may surround the moisture barrier film layer.

The thermoformed quality of the film layer, in combination with the unique construction of the first and second heat-induced pre-form film half shells, prevents gaps from forming between the film layer and an outer surface of the subassembly which it protects, thereby minimizing adhesion problems and producing a uniform and continuous (without pin holes), yet very thin film layer that meanwhile does not negatively change or otherwise interfere with or impact/alter targeted golf ball characteristics. It is envisioned that the heat-induced pre-form film half shells and such outer layer such as a cover may be molded simultaneously or in separate molding steps.

The heat-induced pre-form film half shells may be assembled about the subassembly by hand or machine, and together can then be subjected to heat-induced compression molding. A compression molding mold typically has a mold cavity formed in a pair of hemispherical molds, into which the heat-induced pre-form film half shells assembled about the subassembly may be placed. A combination of heat and pressure is then applied, and results in the heat-induced pre-form film half shells being fused to the outer surface of the subassembly as a unitary one-piece very thin moisture barrier layer about the subassembly. Then a cover layer may be formed about the very thin moisture barrier layer in a separate step using one of several possible methods for forming cover layers, depending on the cover material being used—such as injection molding, discussed in more detail further below.

Embodiments are also envisioned wherein the pair of hemispherical molds have an array of protrusions machined or otherwise provided in its cavity for forming a dimple pattern on the periphery of the golf ball during the cover molding operation, and a pair of hemispherical cover blanks can be placed in a diametrically opposed position on the assembly of the heat-induced pre-form film half shells and subassembly and together be placed in the hemispherical molds, and subjected to the heat-induced compression molding operation. In such an embodiment, the pair of hemispherical cover blanks fuse to the outer surface of very thin moisture barrier layer to form a unitary one-piece cover structure which encapsulates a one-piece very thin moisture barrier layer that has also formed.

A heat-induced pre-form film half shell may be made using as single-ply or multi-ply (co-extruded) film sheet. A multi-ply film sheet may contain two or more very, very thin differing layers of material. Advantageously, each of the very, very thin differing layers of material can serve/contribute a primary benefit in the resulting very thin moisture barrier film layer with respect to adjacent layers. For example, a multilayered film sheet may include a first layer that creates excellent adhesion between the resulting very thin film moisture barrier layer and the subassembly, while an intermediate layer of the multi-layered film sheet may provide excellent protection against moisture penetration into the subassembly, with an third layer of the multi-layer film sheet creating great adhesion between the resulting multi-layer film and a surrounding outer layer such as a cover. In such a case, all three layers of the multi-layer film sheet, combined, may together impart excellent moisture barrier properties to protect the core/subassembly against moisture penetration as well as adhesion when incorporated into the golf ball as thermoformed, heat-induced pre-formed very thin film half shells.

Regardless of the particular film sheet selected (i.e., whether single material or multi-ply), it is the unique construction of the thermoformed, heat-induced pre-formed very thin film half shells—which addresses and overcomes the disadvantages of prior golf balls incorporating thin moisture barrier film layers by advantageously creating a continuous and substantially uniform very thin film moisture barrier film layer that is conformally and adhesively mated onto and about the outer surface of the core/subassembly and durably protects the subassembly to a great extent, namely wherein the nMVTR is less than 4.0, or less than 3.0, or less than 2.0, and even less than 1.0, or about 0.8 or less, or about 0.5 or less, or about 0.4 or less.

A desirably sufficient degree of adhesion is produced between the film layer and adjacent layers at interfaces there between, which may be evaluated, for example, using a physical Peel Test. In this regard, a strip of approximately ½ inch may be cut around an equator of the golf ball, deep enough to cut through the entire layer to be tested. Next, a perpendicular cut may be made across the strip and one end of the strip may be peeled back just enough to make a tab of about ½ inch. The ball may then be clamped into a jig by poles with the tab facing upward. The jig allows the clamped ball to freely rotate about an axis parallel to the poles. The tab is then clamped to a 20 lb. load cell of a universal testing machine. The tab may then be pulled away from the ball at a rate of 0.5 in./min., and the force required to pull the outer layer off of the underlying layer is recorded.

In one embodiment, an adhesive strength between the film layer and an adjacent inner layer is at least about 1.1 $lb_f$/in, or greater than 2 $lb_f$/in. In another embodiment, an adhesive strength between the film layer and an adjacent inner layer is about 5 $lb_f$/in or greater. In yet another embodiment, an adhesive strength between the film layer and an adjacent inner layer is about 10 $lb_f$/in or greater. In still another embodiment, an adhesive strength between the film layer and an adjacent inner layer is about 15 $lb_f$/in or greater. In an alternative embodiment, an adhesive strength between the film layer and an adjacent inner layer is about 20 $lb_f$/in or greater. In a different embodiment, an adhesive strength between the film layer and an adjacent inner layer is greater than 25 $lb_f$/in, or greater than 30 $lb_f$/in.

In one embodiment, an adhesive strength between the film layer and an adjacent outer layer is greater than 2 $lb_f$/in. In another embodiment, an adhesive strength between the film layer and an adjacent outer layer is about 5 $lb_f$/in or greater. In yet another embodiment, an adhesive strength between the film layer and an adjacent outer layer is about 10 $lb_f$/in or greater. In still another embodiment, an adhesive strength between the film layer and an adjacent outer layer is about 15 $lb_f$/in or greater. In an alternative embodiment, an adhesive strength between the film layer and an adjacent outer layer is about 20 $lb_f$/in or greater. In a different embodiment, an adhesive strength between the film layer and an adjacent outer layer is greater than 25 $lb_f$/in, or greater than 30 $lb_f$/in.

The following are non-limiting examples of golf ball constructions that can incorporate thermoformed first and second heat-induced pre-form film half shells. In a first example, a golf ball of the invention may include a single or multi-layered rubber-based core having a diameter of about 1.58", which is surrounded and encased by the very thin moisture barrier film layer having a thickness of less than about 0.02 inches and an nMVTR of about 0.5, and consists of thermoformed heat-induced pre-form film half shells containing single layer sheets of polyolefin-based vulcanized thermoplastic elastomer, namely Adv. Elastomer Santoprene®203-50, or ®201-87, or ®201-73. The pre-forms are made by heat-induced vacuum form molding, and then assembled about the core and compression molded. A polyurethane cover may be formed about the very thin moisture barrier film layer to complete the golf ball. The cover in this embodiment has a thickness of 0.045 inches. Embodiments are envisioned wherein the cover may be thermoset or thermoplastic material as desired.

In second example, a golf ball of the invention may incorporate the same core and cover as included in the golf ball of the first example, except that in the second example, the very thin moisture barrier film layer has a thickness of about 0.005 inches, an nMVTR of about 0.8, and consists of thermoformed heat-induced pre-form film half shells each containing a single layer sheet of PE AA copolymer, namely BASF Lucalen®A2910M or Lucalen®A3710MX, rather than being based on Santoprene®TPE sheets.

In a third example, a golf ball of the invention may incorporate the same core and cover as included in the golf balls of the first and second examples, except that in the third example, the very thin moisture barrier film layer has a thickness of about 0.004 inches, an nMVTR of about 0.5, and consists of thermoformed heat-induced pre-form film half shells each containing a five layer sheet of Dow Saranex®453 (LPDE/EVA/PVDC/EVA/LDPE (per sheet)) rather than Santoprene®TPE or Lucalen®A2910M (or Lucalen®A3710MX).

In a fourth example, a golf ball of the invention may include a single or multi-layered rubber-based core having a diameter of about 1.50". The core is surrounded by a three layer cover arrangement consisting of an ionomeric inner cover layer, surrounded and encased by a very thin moisture barrier film layer having a thickness of less than about 0.02 inches and an nMVTR of about 0.5 and consisting of thermoformed heat-induced pre-form film half shells containing single layer sheets of polyolefin-based vulcanized thermoplastic elastomer, namely Santoprene®TPE, which is surrounded by a polyurethane cover layer to complete the golf ball. In such an embodiment, the subassembly consists of the single or multi-layered rubber-based core surrounded by the ionomeric inner cover layer, and the heat-induced pre-form film half shells can be heat-induced compression molded thereabout. The cover in this embodiment, excluding the very thin moisture barrier film layer, has a thickness of 0.030 inches.

In a fifth example, a golf ball of the invention may incorporate the same core and cover arrangement as the golf ball of the third example, except that in this fifth example, the very thin moisture barrier film layer has a thickness of about 0.005 inches, an nMVTR of about 0.8, and consists of thermoformed heat-induced pre-form film half shells each containing a single layer sheet of PE AA copolymer, namely Lucalen®A2910M or Lucalen®A3710MX, rather than being based on Santoprene®TPE sheets.

In a sixth example, a golf ball of the invention may incorporate the same core and cover as included in the golf balls of the fourth and fifth examples, except that in the sixth example, the very thin moisture barrier film layer has a thickness of about 0.004 inches, an nMVTR of about 0.5, and consists of thermoformed heat-induced pre-form film half shells each containing a five layer sheet of Dow Saranex®453 (LPDE/EVA/PVDC/EVA/LDPE (per sheet)) rather than Santoprene®TPE or Lucalen®A2910M (or Lucalen®A3710MX).

Advantageously, a single very thin moisture barrier film layer should sufficiently protect all inner layers of a golf ball construction from moisture penetration without the need for multiple very thin moisture barrier film layers. However, it should be understood that embodiments are envisioned wherein a golf ball construction may include two or greater very thin moisture barrier film layers.

Thus, it is understood that the moisture barrier film layer of thermoformed heat-induced pre-form film half shells may be used in connection with any known golf ball construction to protect moisture from penetrating into inner layers having a greater nMVTR than that of the moisture barrier film layer of thermoformed heat-induced pre-form film half shells. Meanwhile, the moisture barrier film layer of thermoformed heat-induced pre-form film half shells is particularly useful there its nMVTR is lower or less than that of any surrounding golf ball layer. In a golf ball of the invention, the subassembly and/or outer layer surrounding the very thin moisture barrier film layer may be formed from conventional thermoset and/or thermoplastic materials, with the one limitation being that the very thin moisture barrier film layer generally should surround and be adjacent to a layer containing a material that is vulnerable to moisture penetration. Embodiments are envisioned, however, wherein the very thin moisture barrier film layer surrounds and is adjacent to a layer formed about the layer containing a material that is vulnerable to moisture penetration.

Golf balls of the invention can be of any size, although the USGA requires that golf balls used in competition have a diameter of at least 1.68 inches. For play outside of United States Golf Association (USGA) rules, the golf balls can be of a smaller size. Normally, golf balls are manufactured in accordance with USGA requirements and have a diameter in the range of about 1.68 to about 1.80 inches. Also, the USGA has established a maximum weight of 45.93 g (1.62 ounces) for golf balls. For play outside of USGA rules, the golf balls can be heavier. Thus, the diameter of the golf balls may be, for example, from about 1.680 inches to about 1.800 inches, or from about 1.680 inches to about 1.760 inches, or from about 1.680 inches (43 mm) to about 1.740 inches (44 mm), or even anywhere in the range of from 1.700 to about 1.950 inches.

The diameter and thickness of the different layers (other than the very thin moisture barrier film layer), along with properties such as hardness and compression, may vary depending upon the desired playing performance properties of the golf ball such as spin, initial velocity, and feel. The term, "layer", as used herein, means generally any spherical portion of the golf ball and includes the very thin moisture barrier film layer, although the very thin moisture barrier film layer should not negatively impact or otherwise alter golf ball playing characteristics.

Accordingly, the dimensions of each golf ball component such as the diameter of the core and respective thicknesses of the intermediate layer (s), cover layer(s) and/or coating layer(s) may be selected and coordinated as known in the art for targeting and achieving such desired playing characteristics or feel. Ideally, a golf ball of the invention is at least a three-piece golf ball, including the very thin moisture barrier film layer. However, embodiments are indeed envisioned wherein a golf ball of the invention may have two layers including the very thin moisture barrier film layer, with the limitation being that in such an embodiment, the surface properties of the very thin moisture barrier film layer should be such that the golf ball could withstand the great force of a club striking that surface without cracking or otherwise breaking or becoming vulnerable to moisture penetration.

In one embodiment, the golf ball may comprise a single core and a single cover layer or coating layer, wherein the very thin moisture barrier film layer is disposed about the core and is surrounded by the cover or coating layer.

In another version, a golf ball of the invention may incorporate a dual-layered core, a single-layered cover, and at least one very thin moisture barrier film layer. The dual-core includes an inner core (center) and surrounding outer core layer. In this embodiment, a very thin moisture barrier film layer may be disposed between the inner core and the outer core layer, or between the outer core layer and single-cover layer, or both, depending on whether the materials selected for the inner core and/or outer core layer are typically vulnerable to moisture penetration.

In another version, the golf ball may contain a single core layer and two cover layers, with at least one very thin moisture barrier film layer disposed as needed to prevent moisture from penetrating a particular inner layer of the golf ball—i.e., between the single core layer and innermost cover layer, or between the inner cover layer and outer cover layer, or both. In yet another version, a golf ball may contain a dual-core and dual-cover (inner cover layer and outer cover layer), and at least one very thin moisture barrier film layer may be disposed as needed to prevent moisture from penetrating a particular inner layer of the golf ball—between the inner core layer and outer core layer, between the outer core layer and inner cover layer, between the inner cover layer and outer cover layer, or combinations thereof.

In still another embodiment, a golf ball of the invention may contain a dual-core; an inner cover layer, an intermediate cover layer, and an outer cover layer, with at least one very thin moisture barrier film layer disposed as needed between to given of these layer to prevent moisture from penetrating into the inner layer of the two given layers. Or, a golf ball may contain a three-layered core with an innermost core layer (or center), an intermediate core layer, and outer core layer, and a two-layered cover with an inner and outer cover layer, and at least one very thin moisture barrier film layer disposed as needed between two given layers of the construction in order to prevent moisture from penetrating a particular inner layer of the golf ball.

That being said, a core layer in a golf ball of the invention may for example be solid, semi-solid, fluid-filled, or hollow, and may have a single-piece or multi-piece structure. The overall diameter of the core and all intermediate layers is often about 80 percent to about 98 percent of the overall diameter of the finished ball. A variety of materials may be used to make the core including thermoset compositions such as rubber, styrene butadiene, polybutadiene, isoprene, polyisoprene, trans-isoprene; thermoplastics such as ionomer resins, polyamides or polyesters; and thermoplastic and thermoset polyurethane and polyurea elastomers. In one embodiment, the core is a single-piece made from a natural or synthetic rubber composition such as polybutadiene. In other instances, a two-piece core is constructed; that is, there may be two core layers. For example, an inner core portion may be made of a first base rubber material and an outer core layer, which surrounds the inner core, may be made of a second base rubber material. The respective core pieces may be made of the same or different rubber materials. Cross-linking agents and fillers may be added to the rubber materials.

More particularly, materials for solid cores typically include compositions having a base rubber, a filler, an initiator agent, and a cross-linking agent. The base rubber typically includes natural or synthetic rubber, such as polybutadiene rubber. In one embodiment, the base rubber is 1,4-polybutadiene having a cis-structure of at least 40%. The polybutadiene can be blended with other elastomers such as natural rubber, polyisoprene rubber, styrene-butadiene rubber and/or other polybutadienes. Another suitable rubber that may be used in the core is trans-polybutadiene. This polybutadiene isomer is formed by converting the cis-isomer of the polybutadiene to the trans-isomer during a molding cycle. A soft and fast agent such as pentachlorothiophenol (PCTP) or ZnPCTP can be blended with the polybutadiene. These compounds may also function as cis-to-trans catalyst to convert some cis-1,4 bonds in the polybutadiene into trans 1,4 bonds.

Fillers, which may be used to modify such properties as the specific gravity (density-modifying materials), hardness, weight, modulus, resiliency, compression, and the like may be added to the core composition. Normally, the fillers are inorganic, and suitable fillers include numerous metals or metal oxides, such as zinc oxide and tin oxide, as well as barium sulfate, zinc sulfate, calcium carbonate, barium carbonate, clay, tungsten, tungsten carbide, silica, and mixtures thereof. Fillers may also include various foaming agents or blowing agents, zinc carbonate, regrind (recycled core material typically ground to about 30 mesh or less particle size), high-Mooney-viscosity rubber regrind, and the like. In addition, polymeric, ceramic, metal, and glass microspheres may be used.

Again, the hardness of the core may vary depending upon the desired properties of the ball.

The core may for example have a diameter ranging from about 0.09 inches to about 1.65 inches. In one embodiment, the diameter of the core of the present invention is about 1.2 inches to about 1.630 inches. For example, when part of a two-piece ball according to invention, the core may have a diameter ranging from about 1.5 inches to about 1.62 inches. In another embodiment, the diameter of the core is about 1.3 inches to about 1.6 inches, preferably from about 1.39 inches to about 1.6 inches, and more preferably from about 1.5 inches to about 1.6 inches. In yet another embodiment, the core has a diameter of about 1.55 inches to about 1.65 inches, preferably about 1.55 inches to about 1.60 inches.

In some embodiments, the core may have an overall diameter within a range having a lower limit of 0.500 or 0.700 or 0.750 or 0.800 or 0.850 or 0.900 or 0.950 or 1.000 or 1.100 or 1.150 or 1.200 or 1.250 or 1.300 or 1.350 or 1.400 or 1.450 or 1.500 or 1.600 or 1.610 inches and an upper limit of 1.620 or 1.630 or 1.640 inches. In a particular embodiment, the core is a multi-layer core having an overall diameter within a range having a lower limit of 0.500 or 0.700 or 0.750 or 0.800 or 0.850 or 0.900 or 0.950 or 1.000 or 1.100 or 1.150 or 1.200 inches and an upper limit of 1.250 or 1.300 or 1.350 or 1.400 or 1.450 or 1.500 or 1.600 or 1.610 or 1.620 or 1.630 or 1.640 inches. In another particular embodiment, the multi-layer core has an overall diameter within a range having a lower limit of 0.500 or 0.700 or 0.750 inches and an upper limit of 0.800 or 0.850 or 0.900 or 0.950 or 1.000 or 1.100 or 1.150 or 1.200 or 1.250 or 1.300 or 1.350 or 1.400 or 1.450 or 1.500 or 1.600 or 1.610 or 1.620 or 1.630 or 1.640 inches. In another particular embodiment, the multi-layer core has an overall diameter of 1.500 inches or 1.510 inches or 1.530 inches or 1.550 inches or 1.570 inches or 1.580 inches or 1.590 inches or 1.600 inches or 1.610 inches or 1.620 inches.

In some embodiments, the inner core can have an overall diameter of 0.500 inches or greater, or 0.700 inches or greater, or 1.00 inches or greater, or 1.250 inches or greater, or 1.350 inches or greater, or 1.390 inches or greater, or 1.450 inches or greater, or an overall diameter within a range having a lower limit of 0.250 or 0.500 or 0.750 or 1.000 or 1.250 or 1.350 or 1.390 or 1.400 or 1.440 inches and an upper limit of 1.460 or 1.490 or 1.500 or 1.550 or 1.580 or 1.600 inches, or an overall diameter within a range having a lower limit of 0.250 or 0.300 or 0.350 or 0.400 or 0.500 or 0.550 or 0.600 or 0.650 or 0.700 inches and an upper limit of 0.750 or 0.800 or 0.900 or 0.950 or 1.000 or 1.100 or 1.150 or 1.200 or 1.250 or 1.300 or 1.350 or 1.400 inches. In one embodiment, the inner core consists of a single layer formed from a thermoset rubber composition. In another embodiment, the inner core consists of two layers, each of which is formed from the same or different thermoset rubber compositions. In another embodiment, the inner core comprises three or more layers, each of which is formed from the same or different thermoset rubber compositions. In another embodiment, the inner core consists of a single layer formed from a thermoplastic composition. In another embodiment, the inner core consists of two layers, each of which is formed from the same or different thermoplastic compositions. In another embodiment, the inner core comprises three or more layers, each of which is formed from the same or different thermoplastic compositions. In some embodiments, the outer core layer can have an overall thickness within a range having a lower limit of 0.010 or 0.020 or 0.025 or 0.030 or 0.035 inches and an upper limit of 0.040 or 0.070 or 0.075 or 0.080 or 0.100 or 0.150 inches, or an overall thickness within a range having a lower limit of 0.025 or 0.050 or 0.100 or 0.150 or 0.160 or 0.170 or 0.200 inches and an upper limit of 0.225 or 0.250 or 0.275 or 0.300 or 0.325 or 0.350 or 0.400 or 0.450 or greater than 0.450 inches. The outer core layer may alternatively have a thickness of greater than 0.10 inches, or 0.20 inches or greater, or greater than 0.20 inches, or 0.30 inches or greater, or greater than 0.30 inches, or 0.35 inches or greater, or greater than 0.35 inches, or 0.40 inches or greater, or greater than 0.40 inches, or 0.45 inches or greater, or greater than 0.45 inches, or a thickness within a range having a lower limit of 0.005 or 0.010 or 0.015 or 0.020 or 0.025 or 0.030 or 0.035 or 0.040 or 0.045 or 0.050 or 0.055 or 0.060 or 0.065 or 0.070 or 0.075 or 0.080 or 0.090 or 0.100 or 0.200 or 0.250 inches and an upper limit of 0.300 or 0.350 or 0.400 or 0.450 or 0.500 inches.

In one embodiment, the outer core consists of a single layer formed from a thermoset rubber composition. In another embodiment, the outer core consists of two layers, each of which is formed from the same or different thermoset rubber compositions. In another embodiment, the outer core comprises three or more layers, each of which is formed from the same or different thermoset rubber compositions. In another embodiment, the outer core consists of a single layer formed from a thermoplastic composition. In another embodiment, the outer core consists of two layers, each of which is formed from the same or different thermoplastic compositions. In another embodiment, the outer core comprises three or more layers, each of which is formed from the same or different thermoplastic compositions.

An intermediate core layer can have an overall thickness within a range having a lower limit of 0.005 or 0.010 or 0.015 or 0.020 or 0.025 or 0.030 or 0.035 or 0.040 or 0.045 inches and an upper limit of 0.050 or 0.055 or 0.060 or 0.065 or 0.070 or 0.075 or 0.080 or 0.090 or 0.100 inches. In one embodiment, the intermediate core consists of a single layer formed from a thermoset rubber composition. In another embodiment, the intermediate core consists of two layers, each of which is formed from the same or different thermoset rubber compositions. In another embodiment, the intermediate core comprises three or more layers, each of which is formed from the same or different thermoset rubber compositions. In another embodiment, the intermediate core consists of a single layer formed from a thermoplastic composition. In another embodiment, the intermediate core consists of two layers, each of which is formed from the same or different thermoplastic compositions. In another embodiment, the intermediate core comprises three or more layers, each of which is formed from the same or different thermoplastic compositions.

The compression of the core is generally overall in the range of about 40 to about 110. In other embodiments, the overall CoR of cores of the present invention at 125 ft/s is at least 0.750, or at least 0.775 or at least 0.780, or at least 0.785, or at least 0.790, or at least 0.795, or at least 0.800. Cores are also known to comprise a variety of other materials that are typically also used for intermediate and cover layers. Intermediate layers may likewise also comprise materials generally used in cores and covers as described herein for example.

An intermediate layer is sometimes thought of as including any layer(s) disposed between the inner core (or center) and the outer cover of a golf ball, and thus in some embodiments, the intermediate layer may include an outer core layer, a casing layer, or inner cover layer(s). In this regard, a golf ball of the invention may include one or more intermediate layers. An intermediate layer may be used, if desired, with a multilayer cover or a multilayer core, or with both a multilayer cover and a multilayer core.

In one non-limiting embodiment, an intermediate layer having a thickness of about 0.010 inches to about 0.06 inches, is disposed about a core having a diameter ranging from about 1.5 inches to about 1.59 inches. In this embodiment, the core may consist of a conventional core material such as a rubber composition. In some embodiments, the intermediate layer may be covered by a conventional castable thermoset or injection moldable thermoplastic material or of any other cover materials discussed herein or as is otherwise known in the art.

Intermediate layer(s) may be formed, at least in part, from one or more homopolymeric or copolymeric materials, such as ionomers, primarily or fully non-ionomeric thermoplastic materials, vinyl resins, polyolefins, polyurethanes, polyureas, polyamides, acrylic resins and blends thereof, olefinic thermoplastic rubbers, block copolymers of styrene and butadiene, isoprene or ethylene-butylene rubber, copoly (ether-amide), polyphenylene oxide resins or blends thereof, and thermoplastic polyesters.

The range of thicknesses for an intermediate layer of a golf ball is large because of the vast possibilities when using an intermediate layer, i.e., as an outer core layer, an inner cover layer, a wound layer, a moisture/vapor barrier layer. When used in a golf ball of the present invention, the intermediate layer, or inner cover layer, may have a thickness about 0.3 inches or less. In one embodiment, the thickness of the intermediate layer is from about 0.002 inches to about 0.1 inches, and preferably about 0.01 inches or greater. For example, when part of a three-piece ball or multi-layer ball according to the invention, the intermediate layer and/or inner cover layer may have a thickness ranging from about 0.010 inches to about 0.06 inches. In another embodiment, the intermediate layer thickness is about 0.05 inches or less, or about 0.01 inches to about 0.045 inches for example.

The cover typically has a thickness to provide sufficient strength, good performance characteristics, and durability. In one embodiment, the cover thickness may for example be from about 0.02 inches to about 0.12 inches, or about 0.1 inches or less. For example, the cover may be part of a two-piece golf ball and have a thickness ranging from about 0.03 inches to about 0.09 inches. In another embodiment, the cover thickness may be about 0.05 inches or less, or from about 0.02 inches to about 0.05 inches, or from about 0.02 inches and about 0.045 inches.

The cover may be a single-, dual-, or multi-layer cover and have an overall thickness for example within a range having a lower limit of 0.010 or 0.020 or 0.025 or 0.030 or 0.040 or 0.045 inches and an upper limit of 0.050 or 0.060 or 0.070 or 0.075 or 0.080 or 0.090 or 0.100 or 0.150 or 0.200 or 0.300 or 0.500 inches. In a particular embodiment, the cover may be a single layer having a thickness of from 0.010 or 0.020 or 0.025 inches to 0.035 or 0.040 or 0.050 inches. In another particular embodiment, the cover may consist of an inner cover layer having a thickness of from 0.010 or 0.020 or 0.025 inches to 0.035 or 0.050 inches and an outer cover layer having a thickness of from 0.010 or 0.020 or 0.025 inches to 0.035 or 0.040 inches.

In one embodiment, the cover may be a single layer having a surface hardness of 60 Shore D or greater, or 65 Shore D or greater. In a particular aspect of this embodiment, the cover is formed from a composition having a material hardness of 60 Shore D or greater, or 65 Shore D or greater.

In another particular embodiment, the cover may be a single layer having a thickness of from 0.010 or 0.020 inches to 0.035 or 0.050 inches and formed from an ionomeric composition having a material hardness of from 60 or 62 or 65 Shore D to 65 or 70 or 72 Shore D.

In yet another particular embodiment, the cover is a single layer having a thickness of from 0.010 or 0.025 inches to 0.035 or 0.040 inches and formed from a thermoplastic composition selected from ionomer-, polyurethane-, and polyurea-based compositions having a material hardness of 62 Shore D or less, or less than 62 Shore D, or 60 Shore D or less, or less than 60 Shore D, or 55 Shore D or less, or less than 55 Shore D.

In still another particular embodiment, the cover is a single layer having a thickness of from 0.010 or 0.025 inches to 0.035 or 0.040 inches and formed from a thermosetting polyurethane- or polyurea-based composition having a material hardness of 62 Shore D or less, or less than 62 Shore D, or 60 Shore D or less, or less than 60 Shore D, or 55 Shore D or less, or less than 55 Shore D.

In an alternative embodiment, the cover may comprise an inner cover layer formed from an ionomeric composition and an outer cover layer formed from a thermosetting polyurethane- or polyurea-based composition. The inner cover layer composition may have a material hardness of from 60 or 62 or 65 Shore D to 65 or 70 or 72 Shore D. The inner cover layer may have a thickness within a range having a lower limit of 0.010 or 0.020 or 0.030 inches and an upper limit of 0.035 or 0.040 or 0.050 inches. The outer cover layer composition may have a material hardness of 62 Shore D or less, or less than 62 Shore D, or 60 Shore D or less, or less than 60 Shore D, or 55 Shore D or less, or less than 55 Shore D. The outer cover layer may have a thickness within a range having a lower limit of 0.010 or 0.020 or 0.025 inches and an upper limit of 0.035 or 0.040 or 0.050 inches.

In another embodiment, the cover may comprise an inner cover layer formed from an ionomeric composition and an outer cover layer formed from a thermoplastic composition selected from ionomer-, polyurethane-, and polyurea-based compositions. The inner cover layer composition may have a material hardness of from 60 or 62 or 65 Shore D to 65 or 70 or 72 Shore D. The inner cover layer may have a thickness within a range having a lower limit of 0.010 or 0.020 or 0.030 inches and an upper limit of 0.035 or 0.040 or 0.050 inches. The outer cover layer composition may have a material hardness of 62 Shore D or less, or less than 62 Shore D, or 60 Shore D or less, or less than 60 Shore D, or 55 Shore D or less, or less than 55 Shore D. The outer cover layer may have a thickness within a range having a lower limit of 0.010 or 0.020 or 0.025 inches and an upper limit of 0.035 or 0.040 or 0.050 inches.

In yet another embodiment, the cover is a dual- or multi-layer cover including an inner or intermediate cover layer formed from an ionomeric composition and an outer cover layer formed from a polyurethane- or polyurea-based composition. The ionomeric layer may have a surface hardness of 70 Shore D or less, or 65 Shore D or less, or less than 65 Shore D, or a Shore D hardness of from 50 to 65, or a Shore D hardness of from 57 to 60, or a Shore D hardness of 58, and a thickness within a range having a lower limit of 0.010 or 0.020 or 0.030 inches and an upper limit of 0.045 or 0.080 or 0.120 inches. The outer cover layer may be formed from a castable or reaction injection moldable polyurethane, polyurea, or copolymer or hybrid of polyurethane/polyurea. Such cover material may be thermosetting, but may be thermoplastic in other embodiments. The outer cover layer composition may have a material hardness of 85 Shore C or less, or 45 Shore D or less, or 40 Shore D or less, or from 25 Shore D to 40 Shore D, or from 30 Shore D to 40 Shore D. The outer cover layer may have a surface hardness within a range having a lower limit of 20 or 30 or 35 or 40 Shore D and an upper limit of 52 or 58 or 60 or 65 or 70 or 72 or 75 Shore D. The outer cover layer may have a thickness within a range having a lower limit of 0.010 or 0.015 or 0.025 inches and an upper limit of 0.035 or 0.040 or 0.045 or 0.050 or 0.055 or 0.075 or 0.080 or 0.115 inches.

It is envisioned that golf balls of the invention may also incorporate conventional coating layer(s) for the purposes usually incorporated. For example, one or more coating layer may have a combined thickness of from about 0.1 μm to about 100 μm, or from about 2 μm to about 50 μm, or from about 2 μm to about 30 μm. Meanwhile, each coating layer may have a thickness of from about 0.1 μm to about 50 μm, or from about 0.1 μm to about 25 μm, or from about 0.1 μm to about 14 μm, or from about 2 μm to about 9 μm, for example.

While the heat-induced pre-form film half shells are typically formed about a subassembly using heat-induced compression molding, other golf ball layers of golf balls of the invention may be formed in some embodiments using a variety of application techniques. For example, at least some of the golf ball layers may be formed using compression molding, flip molding, injection molding, retractable pin injection molding, reaction injection molding (RIM), liquid injection molding (LIM), casting, vacuum forming, powder coating, flow coating, spin coating, dipping, spraying, and the like. Conventionally, compression molding and injection molding are applied to thermoplastic materials, whereas RIM, liquid injection molding, and casting are employed on thermoset materials.

In one embodiment, a very thin moisture barrier layer may be covered with a castable thermoset or injection moldable thermoplastic material or any of the other cover materials discussed below. In this embodiment, the core may for example have a diameter of about 0.5 inches to about 1.64 inches and the cover layer thickness may range from about 0.02 inches to about 0.12 inches.

In this regard, covers may have one or more layers as well. The cover material should impart durability, toughness and tear-resistance to the ball. For example, polyurethane/polyurea compositions can be used in the cover layer, because they can provide the cover with high durability as well as a soft feel. In other embodiments, the cover may be made of polymers such as ethylene, propylene, butene-1 or hexane-1 based homopolymers and copolymers including functional monomers such as acrylic and methacrylic acid and fully or partially neutralized ionomer resins and their blends, methyl acrylate, methyl methacrylate homopolymers and copolymers, imidized, amino group containing polymers, polycarbonate, reinforced polyamides, polyphenylene oxide, high impact polystyrene, polyether ketone, polysulfone, poly(phenylene sulfide), acrylonitrile-butadiene, acrylic-styrene-acrylonitrile, poly(ethylene terephthalate), poly(butylene terephthalate), poly(ethylene vinyl alcohol), poly(tetrafluoroethylene) and their copolymers including functional comonomers and blends thereof.

In one embodiment, ionomer resins can be used as the cover material. These cross-linked polymers contain interchain ionic bonding as well as covalent bonding. The ionomer resins include, for example, a copolymer of ethylene and an acid group such as methacrylic or acrylic acid. Metal ions such as sodium, lithium, zinc, and magnesium are used to neutralize the acid groups in the polymer. Commercially available ionomer resins are known in the industry and include numerous resins sold under the trademarks, Surlyn.®. (DuPont) and Escor.® and Iotek.®. (Exxon). These ionomer resins are available in various grades and are identified based on the type of base resin, molecular weight, type of metal ion, amount of acid, degree of neutralization, additives, and other properties.

Non-limiting examples of suitable ionomers include partially neutralized ionomers, blends of two or more partially neutralized ionomers, highly neutralized ionomers, blends of two or more highly neutralized ionomers, and blends of one or more partially neutralized ionomers with one or more highly neutralized ionomers. Methods of preparing ionomers are well known, and are disclosed, for example, in U.S. Pat. No. 3,264,272, the entire disclosure of which is hereby incorporated herein by reference. The acid copolymer can be a direct copolymer wherein the polymer is polymerized by adding all monomers simultaneously, as disclosed, for example, in U.S. Pat. No. 4,351,931, the entire disclosure of which is hereby incorporated herein by reference. Alternatively, the acid copolymer can be a graft copolymer wherein a monomer is grafted onto an existing polymer, as disclosed, for example, in U.S. Patent Application Publication No. 2002/0013413, the entire disclosure of which is hereby incorporated herein by reference.

Examples of suitable partially neutralized acid polymers include, but are not limited to, Surlyn® ionomers, commercially available from E. I. du Pont de Nemours and Company; AClyn® ionomers, commercially available from Honeywell International Inc.; and Iotek® ionomers, commercially available from Exxon Mobil Chemical Company. Some suitable examples of highly neutralized ionomers (HNP) are DuPont® HPF 1000 and DuPont® HPF 2000, ionomeric materials commercially available from E. I. du Pont de Nemours and Company. In some embodiments, very low modulus ionomer- ("VLMI-") type ethylene-acid polymers are particularly suitable for forming the HNP, such as Surlyn® 6320, Surlyn® 8120, Surlyn® 8320, and Surlyn® 9320, commercially available from E. I. du Pont de Nemours and Company.

Any or each of core layers, intermediate/casing layers, and cover layers may be formed from ionomeric materials including blends of ionomers such as blends of HNP materials. The acid moieties of the HNP's, typically ethylene-based ionomers, are preferably neutralized greater than about 70%, more preferably greater than about 90%, and most preferably at least about 100%. The HNP's can be also be blended with a second polymer component, which, if containing an acid group, may also be neutralized. The second polymer component, which may be partially or fully neutralized, may comprise for example ionomeric copolymers and terpolymers, ionomer precursors, thermoplastics, polyamides, polycarbonates, polyesters, polyurethanes, polyureas, polyurethane/urea hybrids, thermoplastic elastomers, polybutadiene rubber, balata, metallocene-catalyzed polymers (grafted and non-grafted), single-site polymers, high-crystalline acid polymers, cationic ionomers, and the like. HNP polymers typically have a material hardness of between about 20 and about 80 Shore D, and a flexural modulus of between about 3,000 psi and about 200,000 psi.

Additional suitable materials for golf ball layers include polyurethanes; polyureas; copolymers and hybrids of polyurethane and polyurea; polyethylene, including, for example, low density polyethylene, linear low density polyethylene, and high density polyethylene; polypropylene; rubber-toughened olefin polymers; acid copolymers, e.g., (meth)acrylic acid, which do not become part of an ionomeric copolymer; plastomers; flexomers; styrene/butadiene/styrene block copolymers; styrene/ethylene-butylene/styrene block copolymers; dynamically vulcanized elastomers; ethylene vinyl acetates; ethylene methyl acrylates; polyvinyl chloride resins; polyamides, amide-ester elastomers, and graft copolymers of ionomer and polyamide, including, for example, Pebax.®. thermoplastic polyether block amides, commercially available from Arkema Inc; crosslinked trans-polyisoprene and blends thereof; polyester-based thermoplastic elastomers, such as Hytrel.®., commercially available from E. I. du Pont de Nemours and Company; polyurethane-based thermoplastic elastomers, such as Elastollan.®., commercially available from BASF; synthetic or natural vulcanized rubber; and combinations thereof.

Thus, in one embodiment, the cover is a single layer formed from a composition selected from the group consisting of ionomers, polyester elastomers, polyamide elastomers, and combinations of two or more thereof. In a second embodiment, the cover may comprise a composition formed from a thermoplastic polyurethane, thermoset polyurethane, thermoplastic polyurea, or thermoset polyurea. In another version, the cover layer comprises a blend of from about 10% to about 90% by weight of the polyurea composition and from about 90% to about 10% of a polyurethane composition. In yet another embodiment, the cover layer comprises a blend of from about 10% to about 90% by weight of the polyurea composition and from about 90% to about 10% of another polymer or other material such as vinyl resins, polyesters, polyamides, and polyolefins.

When used as cover layer materials, polyurethanes and polyureas can be thermoset or thermoplastic. Thermoset materials can be formed into golf ball layers by conventional casting or reaction injection molding techniques. Thermoplastic materials can be formed into golf ball layers by conventional compression or injection molding techniques.

Polyurethane cover compositions that can be used include those formed from the reaction product of at least one polyisocyanate and at least one curing agent. The curing agent can include, for example, one or more diamines, one or more polyols, or a combination thereof. The at least one polyisocyanate can be combined with one or more polyols to form a prepolymer, which is then combined with the at least one curing agent. Thus, when polyols are described herein they may be suitable for use in one or both components of the polyurethane material, that is, as part of a prepolymer and in the curing agent. The curing agent includes a polyol curing agent preferably selected from the group consisting of ethylene glycol; diethylene glycol; polyethylene glycol; propylene glycol; polypropylene glycol; lower molecular weight polytetramethylene ether glycol; 1,3-bis(2-hydroxyethoxy)benzene; 1,3-bis-[2-(2-hydroxyethoxy)ethoxy]benzene; 1,3-bis-{2-[2-(2-hydroxyethoxy)ethoxy]ethoxy}benzene; 1,4-butanediol; 1,5-pentanediol; 1,6-hexanediol; resorcinol-di-(.beta.-hydroxyethyl)ether; hydroquinone-di-(.beta.-hydroxyethyl)ether; trimethylol propane; and combinations thereof.

Suitable polyurethane cover compositions also include those formed from the reaction product of at least one isocyanate and at least one curing agent or the reaction product of at least one isocyanate, at least one polyol, and at least one curing agent. Preferred isocyanates include those selected from the group consisting of 4,4'-diphenylmethane diisocyanate, polymeric 4,4'-diphenylmethane diisocyanate, carbodiimide-modified liquid 4,4'-diphenylmethane diisocyanate, 4,4'-dicyclohexylmethane diisocyanate, p-phenylene diisocyanate, toluene diisocyanate, isophoronediisocyanate, p-methylxylene diisocyanate, m-methylxylene diisocyanate, o-methylxylene diisocyanate, and combinations thereof. Preferred polyols include those selected from the group consisting of polyether polyol, hydroxy-terminated polybutadiene, polyester polyol, polycaprolactone polyol, polycarbonate polyol, and combinations thereof. Preferred curing agents include polyamine curing agents, polyol curing agents, and combinations thereof. Polyamine curing agents are particularly preferred. Preferred polyamine curing agents include, for example, 3,5-dimethylthio-2,4-toluenediamine, or an isomer thereof; 3,5-diethyltoluene-2,4-diamine, or an isomer thereof; 4,4'-bis-(sec-butylamino)-diphenylmethane; 1,4-bis-(sec-butylamino)-benzene, 4,4'-methylene-bis-(2-chloroaniline); 4,4'-methylene-bis-(3-chloro-2,6-diethylaniline); trimethylene glycol-di-p-aminobenzoate; polytetramethyleneoxide-di-p-aminobenzoate; N,N'-dialkyldiamino diphenyl methane; p,p'-methylene dianiline; phenylenediamine; 4,4'-methylene-bis-(2-chloroaniline); 4,4'-methylene-bis-(2,6-diethylaniline); 4,4'-diamino-3,3'-diethyl-5,5'-dimethyl diphenylmethane; 2,2',3,3'-tetrachloro diamino diphenylmethane; 4,4'-methylene-bis-(3-chloro-2,6-diethylaniline); and combinations thereof.

The cover composition is not limited by the use of a particular polyisocyanate. Suitable polyisocyanates include, but are not limited to, 4,4'-diphenylmethane diisocyanate ("MDI"), polymeric MDI, carbodiimide-modified liquid MDI, 4,4'-dicyclohexylmethane diisocyanate ("H.sub.12MDI"), p-phenylene diisocyanate ("PPDI"), toluene diisocyanate ("TDI"), 3,3'-dimethyl-4,4'-biphenylene diisocyanate ("TODI"), isophoronediisocyanate ("IPDI"), hexamethylene diisocyanate ("HDI"), naphthalene diisocyanate ("NDI"); xylene diisocyanate ("XDI"); para-tetramethylxylene diisocyanate ("p-TMXDI"); meta-tetramethylxylene diisocyanate ("m-TMXDI"); ethylene diisocyanate; propylene-1,2-diisocyanate; tetramethylene-1,4-diisocyanate; cyclohexyl diisocyanate; 1,6-hexamethylene-diisocyanate ("HDI"); dodecane-1,12-diisocyanate; cyclobutane-1, 3-diisocyanate; cyclohexane-1,3-diisocyanate; cyclohexane-1,4-diisocyanate; 1-isocyanato-3,3,5-trimethyl-5-isocyanatomethylcyclohexane; methyl cyclohexylene diisocyanate; triisocyanate of HDI; triisocyanate of 2,4,4-trimethyl-1,6-hexane diisocyanate ("TMDI"), tetracene diisocyanate, naphthalene diisocyanate, anthracene diisocyanate; and combinations thereof. Polyisocyanates are known to those of ordinary skill in the art as having more than one isocyanate group, e.g., di-, tri-, and tetra-isocyanate. Preferably, the polyisocyanate is selected from MDI, PPDI, TDI, and combinations thereof. More preferably, the polyisocyanate includes MDI. It should be understood that, as used herein, the term "MDI" includes 4,4'-diphenylmethane diisocyanate, polymeric MDI, carbodiimide-modified liquid MDI, combinations thereof and, additionally, that the diisocyanate employed may be "low free monomer," understood by one of ordinary skill in the art to have lower levels of "free" monomer isocyanate groups than conventional diisocyanates, i.e., the compositions of the invention typically have less than about 0.1% free monomer groups. Examples of "low free monomer" diisocyanates include, but are not limited to Low Free Monomer MDI, Low Free Monomer TDI, and Low Free Monomer PPDI.

The at least one polyisocyanate may have less than 14% unreacted NCO groups. Preferably, the at least one polyisocyanate has no greater than 8.5% NCO, more preferably from 2.5% to 8.0%, or from 4.0% to 7.2%, or from 5.0% to 6.5%.

The cover composition is not limited by the use of a particular polyol. In one embodiment, the molecular weight of the polyol is from about 200 to about 6000. Exemplary polyols include, but are not limited to, polyether polyols, hydroxy-terminated polybutadiene (including partially/fully hydrogenated derivatives), polyester polyols, polycaprolactone polyols, and polycarbonate polyols. Particularly preferred are polytetramethylene ether glycol ("PTMEG"), polyethylene propylene glycol, polyoxypropylene glycol, and combinations thereof. The hydrocarbon chain can have saturated or unsaturated bonds and substituted or unsubstituted aromatic and cyclic groups. Preferably, the polyol includes PTMEG. Suitable polyester polyols include, but are not limited to, polyethylene adipate glycol, polybutylene adipate glycol, polyethylene propylene adipate glycol, ortho-phthalate-1,6-hexanediol, and combinations thereof. The hydrocarbon chain can have saturated or unsaturated bonds, or substituted or unsubstituted aromatic and cyclic groups. Suitable polycaprolactone polyols include, but are not limited to 1,6-hexanediol-initiated polycaprolactone, diethylene glycol initiated polycaprolactone, trimethylol propane initiated polycaprolactone, neopentyl glycol initiated polycaprolactone, 1,4-butanediol-initiated polycaprolactone, and combinations thereof. The hydrocarbon chain can have saturated or unsaturated bonds, or substituted or unsubstituted aromatic and cyclic groups. Suitable polycarbonates include, but are not limited to, polyphthalate carbonate. The hydrocarbon chain can have saturated or unsaturated bonds, or substituted or unsubstituted aromatic and cyclic groups.

Polyamine curatives are also suitable for use in the curing agent of polyurethane compositions and have been found to improve cut, shear, and impact resistance of the resultant balls. Preferred polyamine curatives include, but are not limited to 3,5-dimethylthio-2,4-toluenediamine and isomers thereof; 3,5-diethyltoluene-2,4-diamine and isomers thereof, such as 3,5-diethyltoluene-2,6-diamine; 4,4'-bis-(sec-butylamino)-diphenylmethane; 1,4-bis-(sec-butylamino)-benzene, 4,4'-methylene-bis-(2-chloroaniline); 4,4'-methylene-bis-(3-chloro-2,6-diethylaniline); polytetramethyleneoxide-di-p-aminobenzoate; N,N'-dialkyldiamino diphenyl methane; p,p'-methylene dianiline ("MDA"); m-phenylenediamine ("MPDA"); 4,4'-methylene-bis-(2-chloroaniline) ("MOCA"); 4,4'-methylene-bis-(2,6-diethylaniline); 4,4'-diamino-3,3'-diethyl-5,5'-dimethyl diphenylmethane; 2,2',3,3'-tetrachloro diamino diphenylmethane; 4,4'-methylene-bis-(3-chloro-2,6-diethylaniline); trimethylene glycol di-p-aminobenzoate; and combinations thereof. Preferably, the curing agent includes 3,5-dimethylthio-2,4-toluenediamine and isomers thereof, such as ETHACURE 300. Suitable polyamine curatives, which include both primary and secondary amines, preferably have weight average molecular weights ranging from about 64 to about 2000.

At least one of a diol, triol, tetraol, or hydroxy-terminated curative may be added to the polyurethane composition. Suitable diol, triol, and tetraol groups include ethylene glycol; diethylene glycol; polyethylene glycol; propylene glycol; polypropylene glycol; lower molecular weight polytetramethylene ether glycol; 1,3-bis(2-hydroxyethoxy)benzene; 1,3-bis-[2-(2-hydroxyethoxy)ethoxy]benzene; 1,3-bis-{2-[2-(2-hydroxyethoxy) ethoxy]ethoxy}benzene; 1,4-butanediol; 1,5-pentanediol; 1,6-hexanediol; resorcinol-di-(4-hydroxyethyl)ether; hydroquinone-di-(4-hydroxyethyl) ether; and combinations thereof. Preferred hydroxy-terminated curatives include ethylene glycol; diethylene glycol; 1,4-butanediol; 1,5-pentanediol; 1,6-hexanediol, trimethylol propane, and combinations thereof. Preferably, the hydroxy-terminated curative has a molecular weights ranging from about 48 to 2000. It should be understood that molecular weight, as used herein, is the absolute weight average molecular weight and would be understood as such by one of ordinary skill in the art.

Both the hydroxy-terminated and amine curatives can include one or more saturated, unsaturated, aromatic, and cyclic groups. Additionally, the hydroxy-terminated and amine curatives can include one or more halogen groups. The polyurethane composition can be formed with a blend or mixture of curing agents. If desired, however, the polyurethane composition may be formed with a single curing agent.

Any method known to one of ordinary skill in the art may be used to combine the polyisocyanate, polyol, and curing agent. One commonly employed method, known in the art as a one-shot method, involves concurrent mixing of the polyisocyanate, polyol, and curing agent. This method results in a mixture that is inhomogeneous (more random) and affords the manufacturer less control over the molecular structure of the resultant composition. A preferred method of mixing is known as a pre-polymer method. In this method, the polyisocyanate and the polyol are mixed separately prior to addition of the curing agent. This method affords a more homogeneous mixture resulting in a more consistent polymer composition.

In the casting process, the polyurea and polyurea/urethane compositions can be formed by chain-extending the polyurea prepolymer with a single curing agent or blend of curing agents as described further below. The compositions of the present invention may be selected from among both castable thermoplastic and thermoset materials. Thermoplastic polyurea compositions are typically formed by reacting the isocyanate blend and polyamines at a 1:1 stoichiometric ratio. Thermoset compositions, on the other hand, are cross-linked polymers and are typically produced from the reaction of the isocyanate blend and polyamines at normally a 1.05:1 stoichiometric ratio. In general, thermoset polyurea compositions are easier to prepare than thermoplastic polyureas.

Suitable polyurethanes are further disclosed, for example, in U.S. Pat. Nos. 5,334,673, 6,506,851, 6,756,436, 6,867,279, 6,960,630, and 7,105,623, the entire disclosures of which are hereby incorporated herein by reference. Suitable polyureas are further disclosed, for example, in U.S. Pat. Nos. 5,484,870 and 6,835,794, and U.S. Patent Application No. 60/401,047, the entire disclosures of which are hereby incorporated herein by reference. Suitable polyurethane-urea cover materials include polyurethane/polyurea blends and copolymers comprising urethane and urea segments, as disclosed in U.S. Patent Application Publication No. 2007/0117923, the entire disclosure of which is hereby incorporated herein by reference.

When injection molding is used to form a golf ball layer, the layer composition is typically in a pelletized or granulated form that can be easily fed into the throat of an injection molding machine wherein it is melted and conveyed via a screw in a heated barrel at temperatures of from about 150° F. to about 600° F., preferably from about 200° F. to about 500° F. The molten composition is ultimately injected into a closed mold cavity, which may be cooled, at ambient or at an elevated temperature, but typically the mold is cooled to a temperature of from about 50° F. to about 70° F. After residing in the closed mold for a time of from 1 second to 300 seconds, preferably from 20 seconds to 120 seconds, the core and/or core plus one or more additional core or cover layers is removed from the mold and either allowed to cool at ambient or reduced temperatures or is placed in a cooling fluid such as water, ice water, dry ice in a solvent, or the like.

Castable reactive liquid polyurethanes and polyurea materials may be applied over the inner ball using a variety of application techniques such as casting, injection molding spraying, compression molding, dipping, spin coating, or flow coating methods that are well known in the art. In one embodiment, the castable reactive polyurethanes and polyurea material is formed over the core using a combination of casting and compression molding. Conventionally, compression molding and injection molding are applied to thermoplastic cover materials, whereas RIM, liquid injection molding, and casting are employed on thermoset cover materials.

U.S. Pat. No. 5,733,428, the entire disclosure of which is hereby incorporated by reference, discloses a method for forming a polyurethane cover on a golf ball core. Because this method relates to the use of both casting thermosetting and thermoplastic material as the golf ball cover, wherein the cover is formed around the core by mixing and introducing the material in mold halves, the polyurea compositions may also be used employing the same casting process.

For example, once a polyurea composition is mixed, an exothermic reaction commences and continues until the material is solidified around the core. It is important that the viscosity be measured over time, so that the subsequent steps of filling each mold half, introducing the core into one half and closing the mold can be properly timed for accomplishing centering of the core cover halves fusion and achieving overall uniformity. A suitable viscosity range of the curing urea mix for introducing cores into the mold halves is determined to be approximately between about 2,000 cP and about 30,000 cP, or within a range of about 8,000 cP to about 15,000 cP.

To start the cover formation, mixing of the prepolymer and curative is accomplished in a motorized mixer inside a mixing head by feeding through lines metered amounts of curative and prepolymer. Top preheated mold halves are filled and placed in fixture units using centering pins moving into apertures in each mold. At a later time, the cavity of a bottom mold half, or the cavities of a series of bottom mold halves, is filled with similar mixture amounts as used for the top mold halves. After the reacting materials have resided in top mold halves for about 40 to about 100 seconds, preferably for about 70 to about 80 seconds, a core is lowered at a controlled speed into the gelling reacting mixture.

A ball cup holds the shell through reduced pressure (or partial vacuum). Upon location of the core in the halves of the mold after gelling for about 4 to about 12 seconds, the vacuum is released allowing the core to be released. In one embodiment, the vacuum is released allowing the core to be released after about 5 seconds to 10 seconds. The mold halves, with core and solidified cover half thereon, are removed from the centering fixture unit, inverted and mated with second mold halves which, at an appropriate time earlier, have had a selected quantity of reacting polyurea prepolymer and curing agent introduced therein to commence gelling.

Similarly, U.S. Pat. No. 5,006,297 and U.S. Pat. No. 5,334,673 both also disclose suitable molding techniques that may be utilized to apply the castable reactive liquids employed in the present invention.

However, it is envisioned that layers of golf balls of the invention other than the very thin moisture barrier layer may be made by any known technique to those skilled in the art.

Cover compositions may also include one or more filler (s), such as coloring agents, fluorescent agents, whitening agents, antioxidants, dispersants, UV absorbers, light stabilizers, plasticizers, surfactants, compatibility agents, foaming agents, reinforcing agents, release agents, and the like.

Several suitable cover materials and constructions also include, but are not limited to, those disclosed in U.S. Patent Application Publication No. 2005/0164810, U.S. Pat. Nos. 5,919,100, 6,117,025, 6,767,940, and 6,960,630, and PCT Publications WO00/23519 and WO00/29129, the entire disclosures of which are hereby incorporated herein by reference.

The golf ball of this invention may have single-, dual-, or multi-layered covers preferably having an overall thickness within a range having a lower limit of 0.010 or 0.020 or 0.025 or 0.030 or 0.040 or 0.045 inches and an upper limit of 0.050 or 0.060 or 0.070 or 0.075 or 0.080 or 0.090 or 0.100 or 0.150 or 0.200 or 0.300 or 0.500 inches. In one embodiment, the cover is a single layer having a thickness of from 0.025 inches to 0.035 inches. Again, the cover hardness may be targeted depending on desired playing characteristics. As a general rule, all other things being equal, a golf ball having a relatively soft cover will spin more than a similarly constructed ball having a harder cover.

In the present invention, "compression" is measured according to a known procedure, using an Atti compression test device, wherein a piston is used to compress a ball against a spring. The travel of the piston is fixed and the deflection of the spring is measured. The measurement of the deflection of the spring does not begin with its contact with the ball; rather, there is an offset of approximately the first 1.25 mm (0.05 inches) of the spring's deflection. Cores having a very low stiffness will not cause the spring to deflect by more than 1.25 mm and therefore have a zero compression measurement. The Atti compression tester is designed to measure objects having a diameter of 1.680 inches; thus, smaller objects, such as golf ball cores, must be shimmed to a total height of 1.680 inches to obtain an accurate reading. Conversion from Atti compression to Riehle (cores), Riehle (balls), 100 kg deflection, 130-10 kg deflection or effective modulus can be carried out according to the formulas given in J. Dalton.

In a golf ball if the invention, Coefficient of Restitution or CoR is determined according to a known procedure, wherein a golf ball or golf ball subassembly (for example, a golf ball core) is fired from an air cannon at two given velocities and a velocity of 125 ft/s is used for the calculations. Ballistic light screens are located between the air cannon and steel plate at a fixed distance to measure ball velocity. As the ball travels toward the steel plate, it activates each light screen and the ball's time period at each light screen is measured. This provides an incoming transit time period which is inversely proportional to the ball's incoming velocity. The ball makes impact with the steel plate and rebounds so it passes again through the light screens. As the rebounding ball activates each light screen, the ball's time period at each screen is measured. This provides an outgoing transit time period which is inversely proportional to the ball's outgoing velocity. CoR is then calculated as the ratio of the outgoing transit time period to the incoming transit time period, $CoR=V_{out}/V_{in}=T_{in}/T_{out}$. The CoR value can be targeted, for example, by varying the core peroxide and antioxidant types and amounts as well as the cure temperature and duration.

The surface hardness of a golf ball layer is obtained from the average of a number of measurements taken from opposing hemispheres, taking care to avoid making measurements on the parting line of the core or on surface defects such as holes or protrusions. Hardness measurements are made pursuant to ASTM D-2240 "Indentation Hardness of Rubber and Plastic by Means of a Durometer." Because of the curved surface of the golf ball layer, care must be taken to ensure that the golf ball or golf ball subassembly is centered under the durometer indentor before a surface hardness reading is obtained. A calibrated digital durometer, capable of reading to 0.1 hardness units, is used for all hardness measurements. The digital durometer must be attached to and its foot made parallel to the base of an automatic stand. The weight on the durometer and attack rate conforms to ASTM D-2240. It should be understood that there is a fundamental difference between "material hardness" and "hardness as measured directly on a golf ball." For purposes of the present invention, material hardness is measured according to ASTM D2240 and generally involves measuring the hardness of a flat "slab" or "button" formed of the material. Surface hardness as measured directly on a golf ball (or other spherical surface) typically results in a different hardness value. The difference in "surface hardness" and "material hardness" values is due to several factors including, but not limited to, ball construction (that is, core type, number of cores and/or cover layers, and the like); ball (or sphere) diameter; and the material composition of adjacent layers. It also should be understood that the two measurement techniques are not linearly related and, therefore, one hardness value cannot easily be correlated to the other.

Examples of yet other materials which may be suitable for incorporating and coordinating in order to target and achieve desired playing characteristics or feel include plasticized thermoplastics, polyalkenamer compositions, polyester-based thermoplastic elastomers containing plasticizers, transparent or plasticized polyamides, thiolene compositions, poly-amide and anhydride-modified polyolefins, organic acid-modified polymers, and the like.

Golf balls of the present invention preferably have a moment of inertia ("MOI") of 70-95 $g\cdot cm^2$, preferably 75-93 $g\cdot cm^2$, and more preferably 76-90 $g\cdot cm^2$. For low MOI embodiments, the golf ball preferably has an MOI of 85 $g\cdot cm^2$ or less, or 83 $g\cdot cm^2$ or less. For high MOI embodiment, the golf ball preferably has an MOI of 86 $g\cdot cm^2$ or greater, or 87 $g\cdot cm^2$ or greater. MOI is measured on a model MOI-005-104 Moment of Inertia Instrument manufactured by Inertia Dynamics of Collinsville, Conn. The instrument is connected to a PC for communication via a COMM port and is driven by MOI Instrument Software version #1.2.

Thermoset and thermoplastic layers herein may be treated in such a manner as to create a positive or negative hardness gradient. In golf ball layers of the present invention wherein a thermosetting rubber is used, gradient-producing processes and/or gradient-producing rubber formulation may be employed. Gradient-producing processes and formulations are disclosed more fully, for example, in U.S. patent application Ser. No. 12/048,665, filed on Mar. 14, 2008; Ser. No. 11/829,461, filed on Jul. 27, 2007; Ser. No. 11/772,903, filed Jul. 3, 2007; Ser. No. 11/832,163, filed Aug. 1, 2007; Ser. No. 11/832,197, filed on Aug. 1, 2007; the entire disclosure of each of these references is hereby incorporated herein by reference.

It is understood that the golf balls of the invention incorporating at least one very thin moisture barrier film layer of thermoformed first and second heat-induced preform film half shells as described and illustrated herein represent only some of the many embodiments of the invention. It is appreciated by those skilled in the art that various changes and additions can be made to such golf balls without departing from the spirit and scope of this invention. It is intended that all such embodiments be covered by the appended claims.

A golf ball of the invention may further incorporate indicia, which as used herein, is considered to mean any symbol, letter, group of letters, design, or the like, that can be added to the dimpled surface of a golf ball.

Golf balls of the present invention will typically have dimple coverage of 60% or greater, preferably 65% or greater, and more preferably 75% or greater. It will be appreciated that any known dimple pattern may be used with any number of dimples having any shape or size. For example, the number of dimples may be 252 to 456, or 330 to 392 and may comprise any width, depth, and edge angle. The parting line configuration of said pattern may be either a straight line or a staggered wave parting line (SWPL), for example.

In any of these embodiments the single-layer core may be replaced with a two or more layer core wherein at least one core layer has a hardness gradient.

Other than in the operating examples, or unless otherwise expressly specified, all of the numerical ranges, amounts, values and percentages such as those for amounts of materials and others in the specification may be read as if prefaced by the word "about" even though the term "about" may not expressly appear with the value, amount or range. Accordingly, unless indicated to the contrary, the numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contain certain errors necessarily resulting from the standard deviation found in their respective testing measurements. Furthermore, when numerical ranges of varying scope are set forth herein, it is contemplated that any combination of these values inclusive of the recited values may be used.

Although the golf ball of the invention has been described herein with reference to particular means and materials, it is to be understood that the invention is not limited to the particulars disclosed and extends to all equivalents within the scope of the claims.

What is claimed is:

1. A golf ball comprising:

a subassembly;

a moisture barrier film layer having a continuous and substantially uniform thermoformed thickness of from greater than about 0.0035 inches to 0.010 inches and consisting of first and second heat-induced pre-form film half shells having first and second inner surfaces that are sized, shaped and contoured to receive and conformally and adhesively mate onto and about the subassembly such that the moisture barrier film layer has a normalized Moisture Vapor Transmission Rate ("nMVTR") of about 0.5 g/($m^2$·day); and at least one outer layer disposed about an outer surface of the moisture barrier film layer and having an nMVTR greater than the nMVTR of the moisture barrier film layer;

wherein the moisture barrier film layer consists of five film layers, wherein a second film layer and a fourth film layer are tie layers, and a third film layer is disposed between the second film layer and fourth film layer and consists of a moisture barrier composition;

wherein a first film layer consists of a low density polyethylene composition, the second film layer consists of an ethylene vinyl acetate composition, the third film layer consists of a polyvinylidene chloride composition, the fourth film layer consists of an ethylene vinyl acetate composition, and a fifth film layer consists of a low density polyethylene composition.

2. The golf ball of claim 1, wherein the five film layers have substantially similar thicknesses.

3. The golf ball of claim 1, wherein the second film layer has a thickness that is substantially similar to a thickness of the fourth film layer, and each of the first film layer, third film layer and fifth film layer has a thickness that is greater than the thickness of the second film layer and fourth film layer.

4. The golf ball of claim 1, wherein the subassembly consists of a single layer solid rubber-based core having a spherical outer surface, and wherein the outer layer is a cover comprised of a thermoset or thermoplastic polyurethane composition, and the golf ball has a CoR of at least about 0.800.

5. The golf ball of claim 1, wherein the subassembly consists of a core having a spherical solid rubber-based inner core layer surrounded by at least one outer core layer; and wherein the outer layer is a cover comprised of a thermoset or thermoplastic polyurethane composition, and wherein the golf ball has a CoR of at least 0.800.

6. The golf ball of claim 5, wherein the subassembly has an outermost layer comprising a highly neutralized polymer composition about which the moisture barrier film layer is disposed.

7. The golf ball of claim 6, wherein the outermost layer has an nMVTR that is greater than the nMVTR of the moisture barrier film layer.

8. The golf ball of claim 1, wherein an adhesive strength between the film layer and an adjacent inner layer is at least about 1.1 lb/in.

9. The golf ball of claim 1, wherein an adhesive strength between the film layer and an adjacent outer layer is at least about 15 lb/in.

* * * * *